United States Patent [19]

Tissot

[11] Patent Number: 4,498,442

[45] Date of Patent: Feb. 12, 1985

[54] FUEL INJECTION PUMP

[75] Inventor: Raymond Tissot, Genas, France

[73] Assignee: Robert Bosch GmbH, Stuttgart, Fed. Rep. of Germany

[21] Appl. No.: 482,650

[22] Filed: Apr. 6, 1983

[30] Foreign Application Priority Data

Jun. 29, 1982 [DE] Fed. Rep. of Germany ..... 3224152

[51] Int. Cl.[3] ..... F02M 41/02

[52] U.S. Cl. ..... 123/447; 123/449; 417/462

[58] Field of Search ..... 123/450, 449, 447, 446, 123/510, 514; 417/462

[56] References Cited

U.S. PATENT DOCUMENTS

| | | | |
|---|---|---|---|
| 4,385,610 | 5/1983 | Leblanc | 123/449 |
| 4,401,082 | 8/1983 | Leblanc | 123/459 |
| 4,401,083 | 8/1983 | Leblanc | 123/449 |
| 4,406,263 | 9/1983 | Leblanc et al. | 123/449 |
| 4,407,249 | 10/1983 | Eheim | 123/450 |
| 4,409,939 | 10/1983 | Eheim et al. | 123/447 |

FOREIGN PATENT DOCUMENTS

| | | | |
|---|---|---|---|
| 2102513 | 4/1972 | France | 123/450 |
| 542012 | 3/1977 | U.S.S.R. | 123/450 |

*Primary Examiner*—Magdalen Y. C. Moy
*Attorney, Agent, or Firm*—Edwin E. Greigg

[57] ABSTRACT

A fuel injection pump in which the fuel metering is performed with the aid of an electromechanical fuel metering device with fuel which is at low pressure, and the disposition of the injection with respect to the full compression stroke of the pump piston of the fuel injection pump can be varied by means of a variable withdrawal of fuel at the end of the compression stroke and the resupply of the withdrawn fuel during the intake stroke of the pump piston. A desired injection characteristic can thereby be attained, or a desired, specified portion of a cam elevation curve at which injection is supposed to take place can be selected.

8 Claims, 8 Drawing Figures

FUEL INJECTION PUMP

BACKGROUND OF THE INVENTION

The invention is based on a fuel injection pump for an internal combustion engine. In an injection pump of this type, known from German Pat. No. 915 163, the injection pump is embodied as a so-called pump/nozzle, having a pump piston the end face of which defines a pump work chamber and controls the inflow bore through which the pump work chamber is filled. An oblique control groove is furthermore provided on the jacket face of the pump piston and cooperates with a groove communicating with the pump work chamber; when the control groove and this latter groove coincide during the compression stroke of the pump piston, the remainder of the pumped fuel is permitted to flow out to an overflow reservoir, and at the same time the pumping of fuel out of the pump work chamber to an injection location is interrupted. The overflow chamber is uncoupled from the fuel supply source by a check valve. By means of the rotation of the pump piston, the work chamber is opened up earlier or later during the compression stroke of the pump piston, thus determining the quantity of fuel actually injected. The fuel flowing out during the remainder of the compression stroke is stored, and it then becomes the first fuel returned to the work chamber at the beginning of the intake stroke of the pump piston. The onset of injection of this injection pump is determined by the closure of the inflow bore to the work chamber, that is, by the onset of the compression stroke of the pump piston. The adjustment of the injection onset is effected by influencing the drive means of the pump piston.

In this fuel injection pump, by means of which only a single injection location can be supplied with fuel, the reservoir must be capable of receiving a variable quantity of fuel, because of the difference between the maximum and the minimum injection quantity. The reservoir must accordingly be relatively large. Furthermore, complicated mechanical means are required for adjusting both the instant of injection and the injection quantity. In this embodiment, the supply stroke disadvantageously always occurs at the same point on the cam elevation curve, so that the injection characteristic cannot be intentionally changed but instead varies unintentionally and disadvantageously depending upon the injection quantity.

OBJECT AND SUMMARY OF THE INVENTION

The fuel injection pump according to the invention has the advantage over the prior art that an internal combustion engine can be supplied with fuel by means of a distributor injection pump in which the location of the injection phase within the possible course of the compression stroke of the pump piston can be disposed arbitrarily within a desired range of cam elevation of the cam drive. The metering of the fuel advantageously takes place in the low-pressure range, with high accuracy, and is controllable in a simple manner with electromechanical means.

The invention will be better understood and further objects and advantages thereof will become more apparent from the ensuing detailed description of two preferred embodiments, taken in conjunction with the drawings.

DESCRIPTION OF THE PREFERRED EMBODIMENTS

Figure 1:
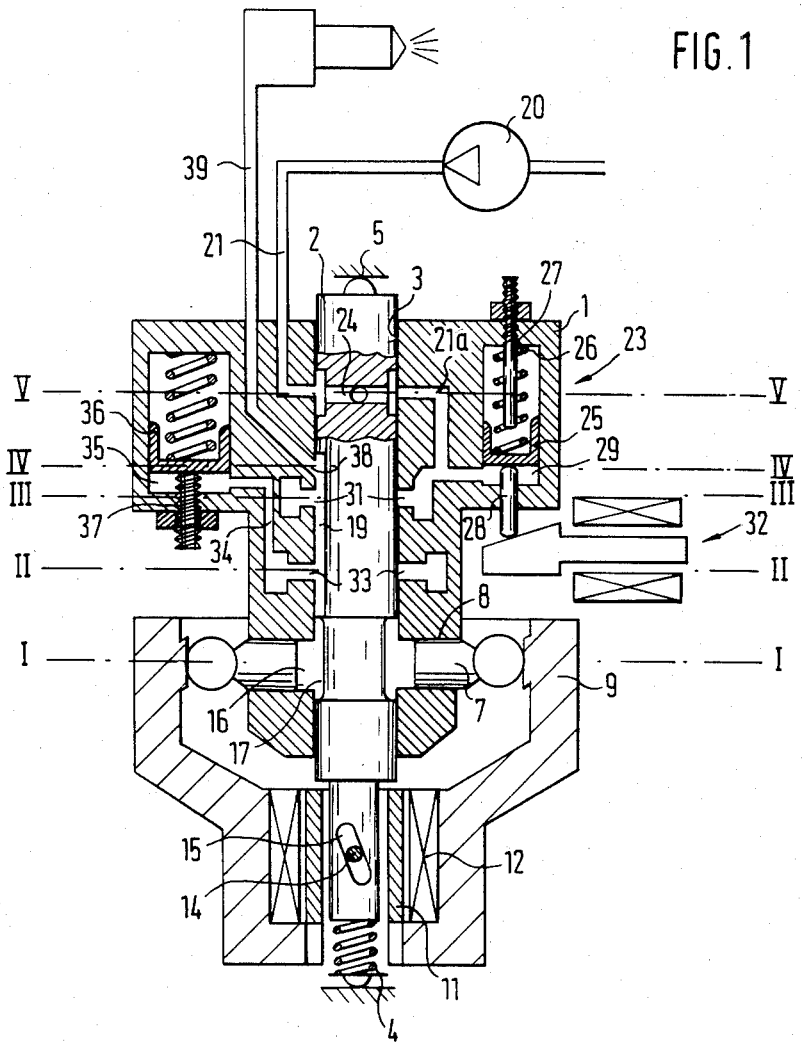
FIG. 1 is a longitudinal section taken through a first form of embodiment of the invention.

A distributor 2 in the form of a driven shaft is supported in a cylinder 3 in a housing 1 of a distributor injection pump. The distributor 2 is pressed on one end in the axial direction against a stop 5 by a spring 4 on the opposite end. Pump pistons 7 are also displaceable in the housing 1 within bores 8 leading radially away in one plane from the cylinder 3. The pump pistons are driven by a cam ring 9, which surrounds the pistons in cup-like fashion and is driven by a drive shaft (not shown) of the fuel injection pump. The distributor 2 is rotationally coupled for rotation with the cam ring 9 via a sheath 11, which is axially displaceable by a magnetic coil 12. The coupling between the sheath 11 and the distributor 2 is effected by means of a pin 14, which engages an oblique recess 15 on the distributor 2. Thus when there is a longitudinal displacement of the sheath 11, a relative rotational movement occurs between the distributor 2 and the cam ring 9.

On the distributor side, the pump pistons 7 enclose a pump work chamber 16 in the bore 8; the individual work chambers of the pistons 7 communicate with one another by means of an annular groove 17 provided in the jacket face of the distributor 2. A control groove 19 in the jacket face leads away from the annular groove 17 in the longitudinal direction, and a plurality of control bores can be made to communicate by means of this control groove 19 with the pump work chamber 16.

The supply of fuel to the fuel injection pump is effected by means of a supply pump 20, which pumps fuel into a fuel supply conduit 21. This conduit 21 discharges into the cylinder 3 and on the opposite side, as the fuel supply conduit 21*a*, leads to a fuel metering device 23. The communication between the fuel supply conduits 21 and 21*a* is controlled by means of two control conduits 24 which pass through the distributor 2 and intersect one another at right angles.

The fuel metering device comprises a displaceable reservoir piston 25, which is displaceable as far as an adjustable stop 27 counter to the force of a spring 26, and the course of the piston 25 is restricted in the other direction, that is, the direction in which spring force is exerted, by an adjustable stop 28 which is controlled by an electromagnetic cam 32. The reservoir chamber 29 enclosed by the piston 25 on one side communicates continuously with all the radially directed inflow openings 31 in the housing, which discharge into the cylinder 3, these inflow openings 31 corresponding in number to the engine cylinders to be supplied and are disposed at intervals corresponding to the sequence of injection in a radial plane surrounding the distributor 2. In this case, as in the case of the control conduits 24, four control openings or inflow openings 31 are provided.

The adjustment of the adjustable stop 28 is effected by means of the adjusting magnet 32 in accordance with the desired rpm and with operating parameters of the engine. The triggering of the adjusting magnet is effected by means of a control device which is not shown further but is known from other sources.

Parallel to the inflow openings 31, relief openings 33 in the housing lead away from the cylinder 3 in a second radial plane, and correspond in their number and disposition to the inflow openings 31. All the relief openings 33 in the housing are interconnected by means of one relief conduit 34, which leads into a reservoir chamber 35. The inflow openings and relief openings have been shown in FIG. 1 such that these openings are not in their true relationship with the openings 38 but have been rotated so that they can be shown. See FIG. 3 for their true relationship. This reservoir chamber 35 is one which is closed in a defined manner by a reservoir piston 36 which is adjustable against a spring force to define the displacement of the chamber 35. The reservoir piston 36 displacement can be varied by means of an adjusting screw 37.

In a third radial plane, supply openings 38 in the housing are provided, corresponding with the number of cylinders and in accordance with the sequence of injection, and from these supply openings 38 in the housing, supply conduits 39 lead to the individual injection locations, one only being shown.

The orientation of the control openings, inflow openings, relief openings and supply openings with respect to the control groove 19 can be learned from the sequence of the drawings in FIGS. 3–7. The control groove 19 represents a longitudinal groove, which encompasses all three radial planes in which the inflow openings 31, the relief openings 33 and the supply openings 38 are disposed. The control groove is widened in the circumferential direction in the vicinity of the supply openings 38. In the vicinity of the relief openings 33, the control groove furthermore has a control edge 40 shown in FIG. 3, which is displaced forward in the rotational direction of the distributor.

Figure 3:
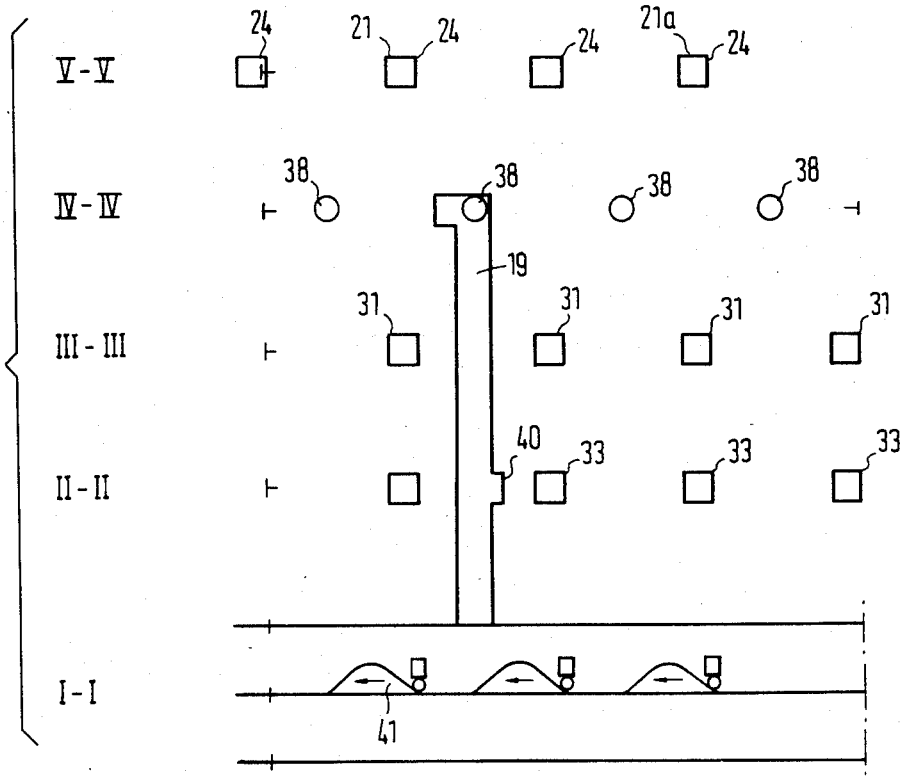
FIGS. 3–7 show individual phases of the control groove with respect to control bores which discharge into the cylinder receiving the distributor.

Referring to the sequence of drawings in FIGS. 3–7, the functioning of the pumps 7 will now be explained. In a first position as shown in FIG. 3, one of the control conduits 24 has established communication between the fuel supply line 21 and the fuel supply line 21*a*. This situation can be seen from the section taken along the line V—V. In the sectional plane IV—IV it can also be seen that the control groove 19 coincides with one of the supply openings 38. All the other openings are now closed by the distributor 2, as the development of the cylinder 3 and of the jacket face of the distributor 2 in FIG. 3 shows. It can also be seen from plane I—I that the two pump pistons 7 at this point are located just at the leading edge of the cam elevation 41 associated with them.

In this position, fuel is delivered by the pump 20 to the reservoir chamber 29, so that the reservoir piston 25 is lifted from the adjustable stop 28 and moved counter to the force of the spring 26 against the fixed stop 27. As the cam ring 9 continues to rotate, the inward movement of the pistons 7 and the positive displacement of the fuel out of the work chamber 17 via the control groove 19 into one supply conduit 39 then takes place.

Figure 4:
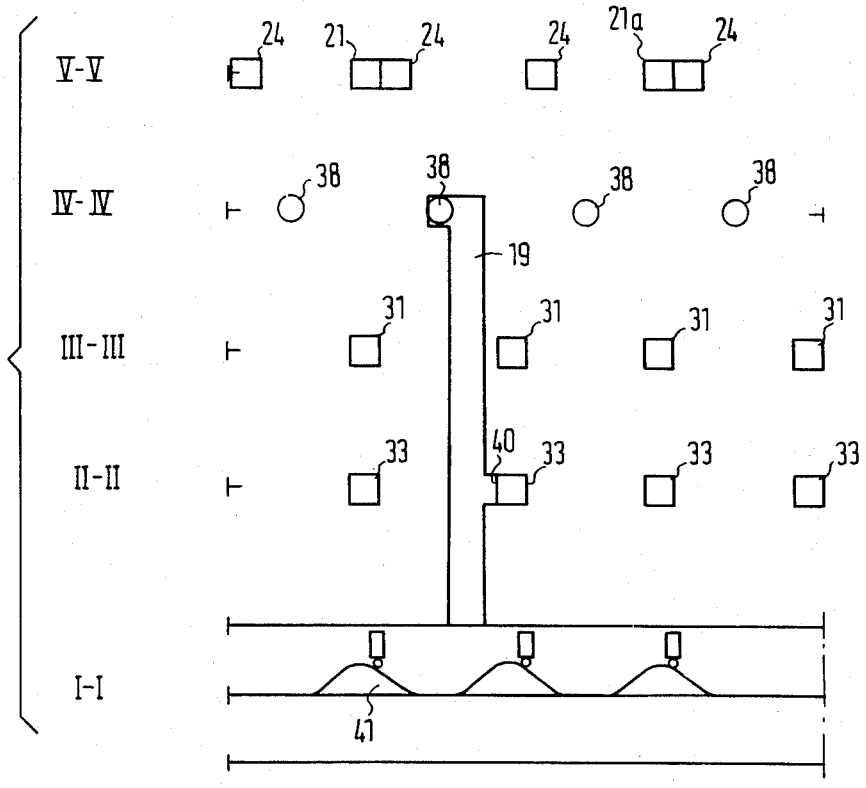
Figure 5:
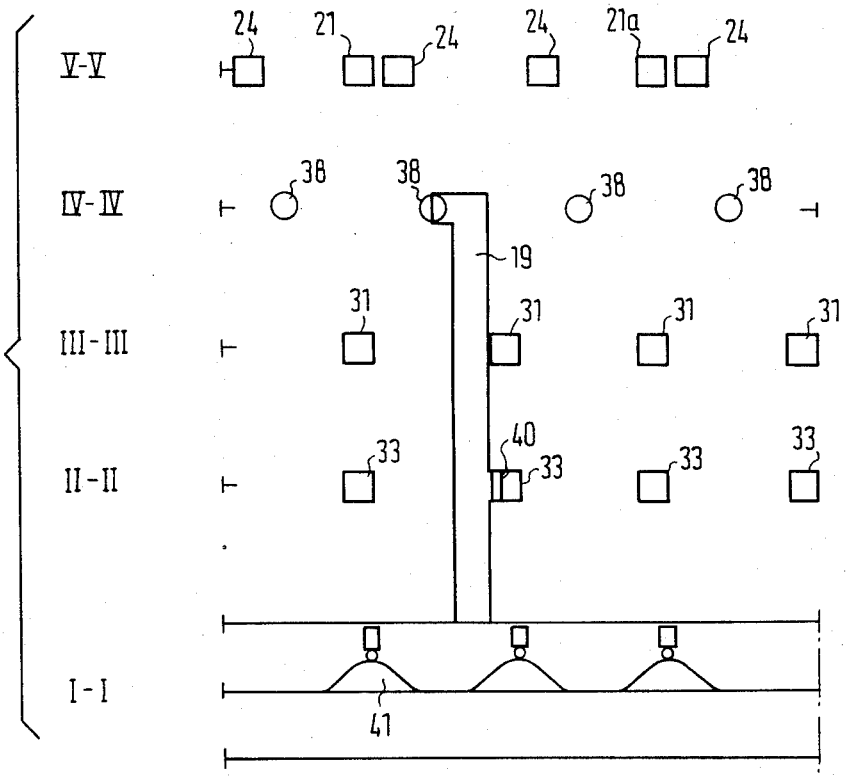
Figure 6:
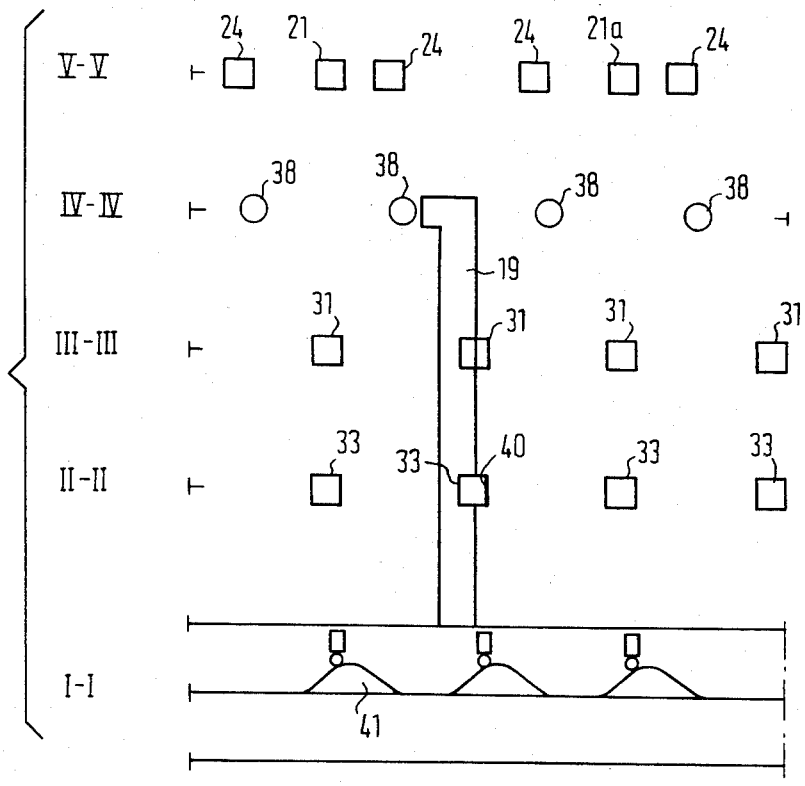

FIG. 4 shows a next working position. Here, the salient control edge 40 of the control groove 19 has attained one of the relief openings 33. With each further rotation, the relief opening 33 is opened, and the fuel now pumped by the pump piston is supplied via the relief conduit 34 into the reservoir chamber 35. At the same time, the communication between the fuel supply conduits 21 and 21*a* is interrupted, so that the metering cycle for the metering device 23 is ended.

Figure 7:
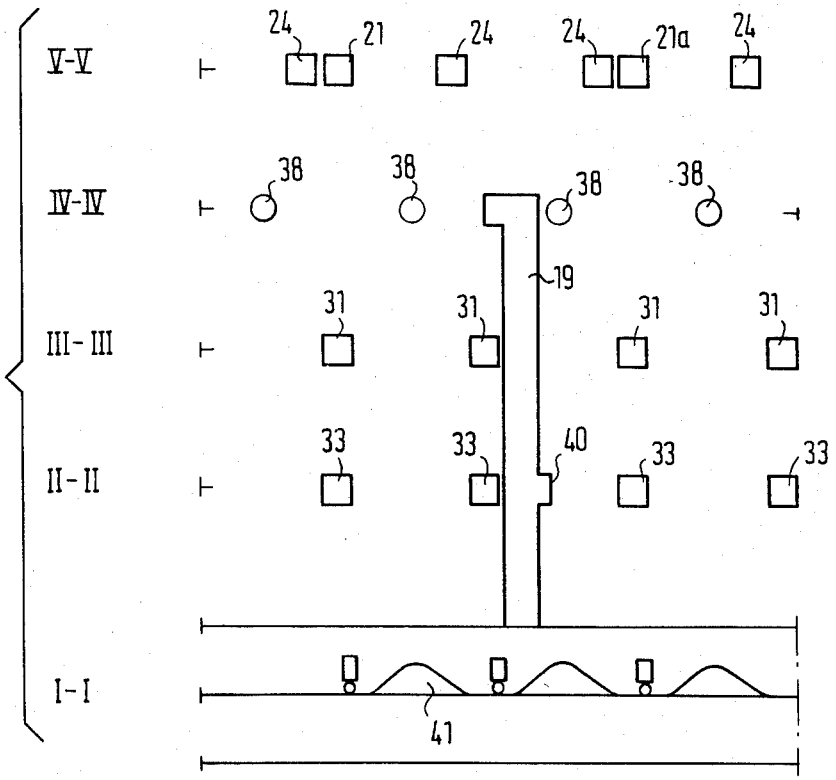

Until the highest point of the cam elevation, the remaining fuel is now pumped into the reservoir chamber 35. When the pump pistons 7 then arrive on the trailing edge of the cam elevation 41, then the fuel stored in the reservoir 35 is resupplied to the work chamber. During this stroke of the pump pistons, that is, the intake stroke, one of the inflow openings 31 is also opened, so that the fuel stored in the fuel metering device 23 is additionally transferred to the work chamber 16. At the end of the filling process, as shown in FIG. 7, the communication with the inflow opening 31 and the relief opening 33 is closed. The deflection of the pump pistons 7 toward the cam ring 9 then corresponds to the metered fuel quantity plus the overflow quantity received by the reservoir chamber 35.

Figure 2:
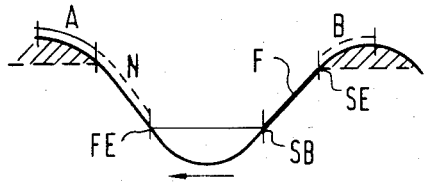
FIG. 2 shows the pressure-elevation curve of the cam drive which drives the pump piston.

This process is also illustrated in greater detail in FIG. 2. The symbol A in the uppermost section of the cam elevation curve indicates the quantity of fuel stored and returned to the pump work chamber 16, while N indicates the metered fuel quantity. N is greater or lesser depending upon the load. The pump piston 7 comes to a stop at the end of the metering at point FE and with the arrival at the next cam elevation at point SB (injection onset) the pump piston 7 is moved back again in the opposite direction. The metered fuel quantity N is now injected over the distance F, until the salient control edge 40 terminates the injection at SE. The remaining quantity B of pumped fuel is then displaced into the reservoir 35.

Depending upon the rotational position of the distributor 2 under the influence of the position of the sheath 11, which is displaced counter to spring force, the opening of the relief opening 33 takes place earlier or later. The fuel quantity transferred into the reservoir 35 becomes greater or smaller accordingly. The end of injection is fixed by the position of the control edge 40, while with a fixed rotational position of the control edge 40, the injection onset is dependent on the quantity of fuel which is to be injected. If a constant end of injection is considered important, then all that is needed is to actuate the fuel quantity metering device in accordance with the fuel intentions. If a constant injection onset is necessary, on the other hand, then the sheath 11 must additionally be displaced by means of the magnetic coil 12. In any case it is possible with the apparatus herein described to locate the actual supplying portion of the full compression stroke of the pistons 7 within an arbitrary range of the pressure elevation curve of the cams 41. In order to perform the control function of the control edge 40, a modified embodiment can also provide that the distributor 2 be displaced longitudinally, in which case the control groove 19 must extend obliquely if the recess 15 has an axially parallel course. The metering of the fuel quantity to be injected is advantageously accomplished in the low-pressure range by means of the storage ahead of the reservoir piston 25. The result is that any metering errors, which may be caused by a variable compressibility of the fuel dependent on dynamic factors, are very slight. Temperature is also substantially prevented from having any influence here.

Figure 8:
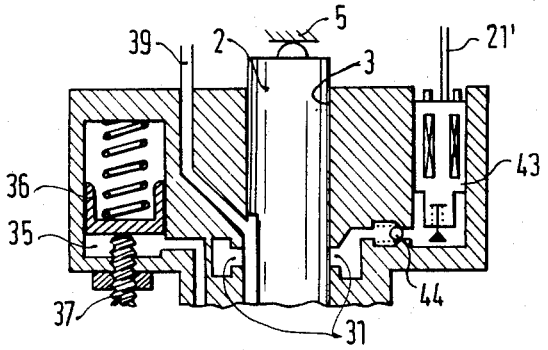
FIG. 8 shows a second exemplary embodiment, in a partial sectional view of a fuel injection pump represented in simplified form.

Instead of the fuel metering device 23 having the reservoir piston 25 as shown in FIG. 1, the metering quantity can also be metered directly during the intake stroke of the pump pistons in accordance with a second exemplary embodiment of the invention as shown in FIG. 8. In this case, the fuel supply line 21' leads directly to an electromechanically actuatable metering valve 43, which is uncoupled from the inflow openings 31 by means of a check valve 44. The control bores 24 of FIG. 1 and the fuel supply line 21*a* are dispensed with. With a rapidly switching magnetic valve or with a piezo valve, the fuel quantity can in this exemplary embodiment be metered in accordance with the opening period of the valve. An advantage of this exemplary embodiment is that in this case as well, the pump work chamber 16 is pressure-equalized by means of the pistons 7, which move outward only in response to fuel pressure and centrifugal force, and constant working conditions prevail during the metering cycle, thus avoiding dynamic fluctuations in the filling process.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection pump having at least one work chamber enclosed by a pump piston in a cylinder in a housing, which work chamber can be made to communicate with an associated fuel injection location via at least one supply line during a compression stroke of the pump piston and with a fuel supply conduit during the filling stroke of the pump piston; a relief conduit leading to a reservoir chamber having a movable wall loaded by a restoring force, the communication of the relief conduit with the work chamber being opened after an adjustable compression stroke of the pump piston, by means of a control edge guided in synchronism with the drive of the pump piston, wherein the location of a control point of the control edge relative to a reference point of the pump piston drive means is variable and wherein the reservoir chamber is connected to the work chamber during the filling stroke of the pump piston, characterized in that the said fuel supply conduit communicates with an adjustable fuel quantity metering device, and said control edge is one limiting edge of a control groove disposed on a jacket face of a distributor rotatable in synchronism with the pump piston and guided in a cylinder wherein the width of said control groove determines the piston stroke during which said relief conduit and said reservoir chamber are connected to said work chamber, the distributor having a distributor groove communicating with the pump work chamber, by means of which distributor groove one after another of a multiplicity of supply lines leading away from the cylinder can be made to communicate, upon the rotation of the distributor, with the pump work chamber during a compression stroke of the pump piston, and that the location of the control point of the control edge relative to a reference point of the pump piston drive means is variable in accordance with operating parameter.

2. A fuel injection pump as defined by claim 1, characterized in that the fuel distributor has an oblique recess, which is engaged by a coupling part connected with the pump piston, this coupling part being displaceable axially with respect to the fuel distributor in accordance with operating parameters in order to rotationally adjust said fuel distributor.

3. A fuel injection pump as defined by claim 1, characterized in that the axial position of the distributor is variable by means of an electromechanical adjusting device.

4. A fuel injection pump as defined by claim 2, characterized in that the axial position of the distributor is variable by means of an electromechanical adjusting device.

5. A fuel injection pump as defined by claim 3, characterized in that the fuel injection pump has a plurality of pump pistons, which are guided in a radial plane relative to the fuel distributor within bores in said housing, and the pump work chambers enclosed with said bores communicate with one another via an annular groove surrounding the distributor and via said annular groove with at least one control groove extending on the jacket face substantially in the longitudinal direction and with the distributor opening, wherein by means of cams moved in synchronism with the distributor the pump pistons are movable radially inward in order to perform the compression stroke, and the control edge of the control groove controls both the relief conduit and the discharge of the fuel injection line.

6. A fuel injection pump as defined by claim 4, characterized in that the control groove is simultaneously embodied as a distributor opening.

7. A fuel injection pump as defined by claim 1 which includes a magnetic means for adjusting the fuel quantity.

8. A fuel injection pump as defined by claim 5 which includes a magnetic means for adjusting the fuel quantity.

* * * * *